US006997002B2

(12) United States Patent
Moon et al.

(10) Patent No.: US 6,997,002 B2
(45) Date of Patent: Feb. 14, 2006

(54) AIR CONDITIONING UNIT AND METHOD OF OPERATING THE SAME

(75) Inventors: Joong-Ki Moon, Seoul (KR); Je-Myoung Moon, Suwon (KR); Dong-Kue Lee, Pyungtak (KR); Jong-Hun Ha, Jinhae (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 197 days.

(21) Appl. No.: 10/482,786

(22) PCT Filed: Jun. 5, 2002

(86) PCT No.: PCT/KR02/01068

§ 371 (c)(1),
(2), (4) Date: Jan. 2, 2004

(87) PCT Pub. No.: WO03/093735

PCT Pub. Date: Nov. 13, 2003

(65) Prior Publication Data

US 2004/0177633 A1 Sep. 16, 2004

(30) Foreign Application Priority Data

May 2, 2002 (KR) ..... 2002-24145

(51) Int. Cl.
*F25B 1/00* (2006.01)
*F25B 49/00* (2006.01)
*H02P 1/26* (2006.01)

(52) U.S. Cl. ..... 62/228.1; 62/228.5; 62/228.4; 318/772; 318/806

(58) Field of Classification Search ..... 62/228.1, 62/228.4, 228.5; 318/772, 806, 800, 801, 318/803

See application file for complete search history.

(56) References Cited

U.S. PATENT DOCUMENTS

| | | | | |
|---|---|---|---|---|
| 4,575,668 | A | | 3/1986 | Baker |
| 4,956,969 | A | | 9/1990 | Raasch |
| 5,017,854 | A | | 5/1991 | Gully et al. |
| 5,136,216 | A | | 8/1992 | Wills et al. |
| 5,252,905 | A | * | 10/1993 | Wills et al. ..... 318/807 |
| 6,065,298 | A | * | 5/2000 | Fujimoto ..... 62/230 |
| 6,172,476 | B1 | | 1/2001 | Tolbert, Jr. et al. |

* cited by examiner

*Primary Examiner*—Chen Wen Jiang
(74) *Attorney, Agent, or Firm*—Staas & Halsey LLP

(57) ABSTRACT

Disclosed herein is an air conditioning unit and method of operating the same. The air conditioning unit has a power level control unit (6) for controlling the level of power supplied to a motor (2*a*) of a compressor. The power level control unit (6) is comprised of a first supplying unit (6*a*) for supplying first level power to the compressor motor (2*a*), and a second supplying unit (6*b*) for supplying second level power to the compressor motor (2*a*). If an operation cycle of the compressor corresponds to a loading operation, the power level control unit (6) supplies first level power for compressing a cooling agent through the first supplying unit (6*a*). Further, if an operation cycle of the compressor corresponds to an unloading operation, the power level control unit (6) supplies second level power less than the first level power through the second supplying unit (6*b*). Therefore, the present invention is advantageous in that it can reduce undesirable power consumption caused by the compressor motor during the unloading operation.

13 Claims, 11 Drawing Sheets

AIR CONDITIONING UNIT AND METHOD OF OPERATING THE SAME

BACKGROUND OF THE INVENTION

1. Field of the Invention

The present invention relates generally to an air conditioning unit and method of controlling the same, and more particularly to an air conditioning unit and method of operating the same, which can reduce power consumption by controlling the level of power supplied to a motor of a compressor according to an operation cycle of the compressor.

2. Description of the Prior Art

Recently, as buildings have become large-sized, demand for multi-air conditioners in which an outdoor unit is connected to a plurality of indoor units has increased.

In general, the individual indoor units of such a multi-air conditioner have different required cooling capacities, and are independently operated, such that a total cooling capacity obtained by summing up the required cooling capacities of all indoor units is also varied. In order to meet the variation of the total required cooling capacity, the capacity of a compressor is adjusted according to the variation of the total required cooling capacity, and the opening ratio of an electric expansion valve situated upstream of an indoor heat exchanger or evaporator is controlled for each of the indoor units.

There are a variable-speed compressor and a pulse width modulation (PWM) compressor as a variable-capacity compressor having a capacity to be varied according to the variation of a required cooling capacity.

The PWM compressor adjusts the capacity of the compressor to correspond to a required cooling capacity by varying the capacity of the compressor in response to a duty control signal used to determine a loading operation for discharging a cooling agent and an unloading operation for not discharging the cooling agent.

Meanwhile, the PWM compressor is supplied with power regardless of whether the loading or the unloading operation is proceeded, and a motor of the compressor rotates at constant speed. Further, if the supply of power to the compressor is interrupted, the compressor motor does not rotate, and the operation of the compressor stops.

In the PWM compressor, power required for the loading operation is greater than that for the unloading operation, which is due to a fact that much power is required for compressing the cooling agent during the loading operation. Further, during the unloading operation, only minimal power for no-load operation is required, such that the unloading operation requires little power relatively to the loading operation.

However, in the conventional PWM compressor, a compressor driving circuit to drive the compressor is produced in consideration of the loading operation, that is, an operating condition of high power consumption. Accordingly, even during the unloading operation of the PWM compressor, driving power is supplied under the same condition as that of the loading operation, thus causing undesirable power consumption during the unloading operation.

The PWM compressor periodically repeats the unloading operation and the loading operation according to a required cooling capacity. Therefore, undesirable power consumption occurs inevitably whenever the PWM compressor performs the unloading operation. Consequently, there is required an improved method of controlling power (power level) according to an operation cycle of the compressor.

SUMMARY OF THE INVENTION

Accordingly, the present invention has been made keeping in mind the above problems occurring in the prior art, and an object of the present invention is to provide an air conditioning unit and method of operating the same, which can reduce power consumption by controlling the level of power supplied to a motor of a compressor according to an operation cycle of the compressor.

In order to accomplish the above object, the present invention provides a pulse width modulation (PWM) compressor, comprising a motor; a first motor controller for supplying first level power to said motor during a loading operation of said compressor; and a second motor controller for supplying second level power less than said first level power to said motor during an unloading operation of said compressor.

Further, the present invention provides a compressor having operation cycles including a loading operation and an unloading operation, comprising a motor for receiving first level power during said loading operation of said compressor and receiving second level power less than said first level power during said unloading operation of said compressor.

Further, the present invention provides an air conditioning unit, comprising a compressor for performing a loading operation and an unloading operation and compressing a cooling agent during said loading operation, said compressor including a motor for receiving first level power during said loading operation of said compressor and receiving second level power less than said first level power during said unloading operation.

Further, the present invention provides a method of operating a compressor in an air conditioning unit, said compressor having a loading operation for compressing a cooling agent and an unloading operation, comprising the steps of supplying first level power to a motor of said compressor during said loading operation; and supplying second level power less than said first level power to said motor during said unloading operation.

Further, the present invention provide an air conditioning unit comprising a compressor having a loading operation for compressing a cooling agent and an unloading operation; and a controller for controlling said compressor, said controller comprising, a power level control circuit for controlling power level supplied to a motor of said compressor, said power level control circuit allowing first level power to be supplied to said motor during said loading operation and allowing second level power less than said first level power to be supplied to said motor during said unloading operation.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the attached drawings.

Figure 1:
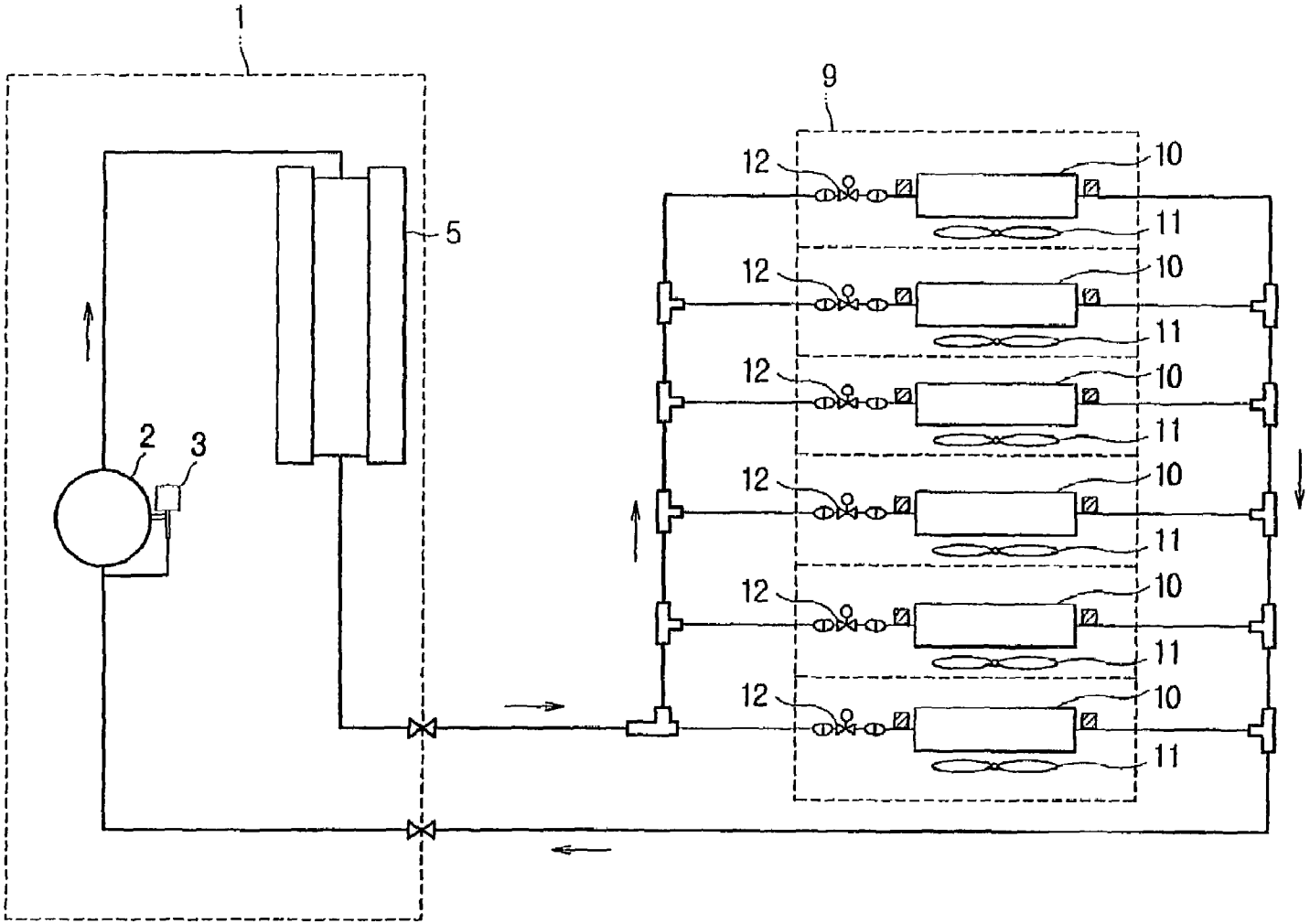
FIG. 1 is a view showing a freezing cycle of an air conditioning unit according to the present invention.

FIG. 1 is a view showing a freezing cycle of an air conditioning unit according to the present invention.

The air conditioning unit of the present invention comprises an outdoor unit 1 and a group of indoor units 9. The outdoor unit 1 comprises a compressor 2 and a condenser 5. The compressor 2 is a PWM compressor which performs a loading operation for discharging a cooling agent through a PWM valve 3 and an unloading operation for not discharging the cooling agent.

The indoor unit group 9 is comprised of a plurality of indoor units arranged in parallel with each other and connected to the outdoor unit 1. Each indoor unit of the indoor unit group 9 has an electric expansion valve 12 and an evaporator 10. Therefore, the air conditioning unit has a construction in which a plurality of indoor units are commonly connected to one outdoor unit 1. The capacities and types of the indoor units of the indoor unit group 9 may be identical or different.

Figure 2:
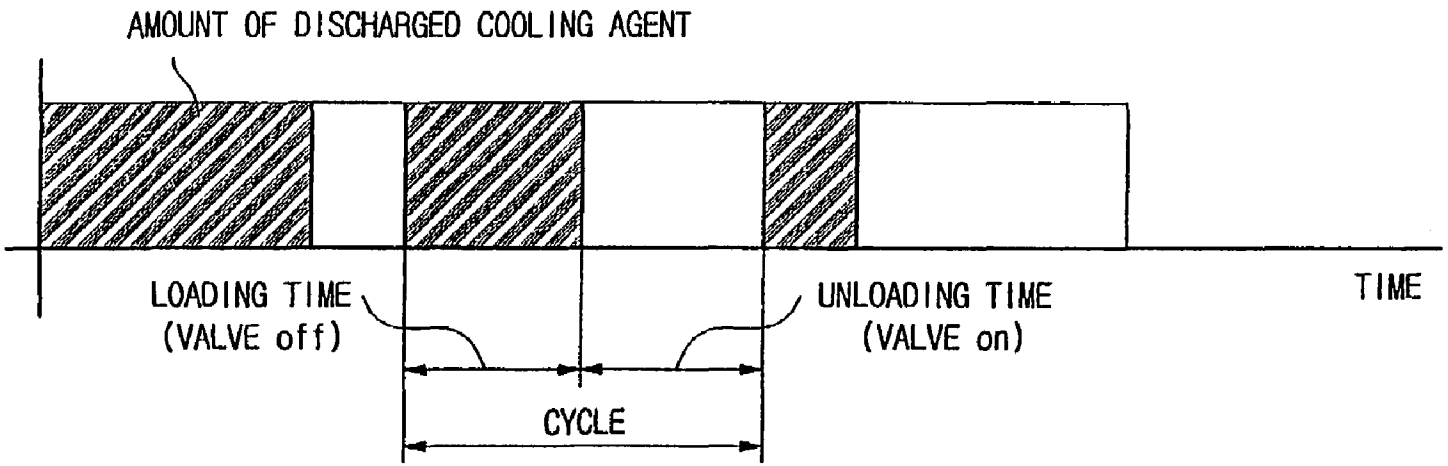
FIG. 2 is a view showing a relationship between loading and unloading operations of a compressor, and the amount of discharged cooling agent.

As shown in FIG. 2, the compressor 2 repeatedly performs the loading operation of discharging the cooling agent through the PWM valve 3 which is turned off, and the unloading operation of not discharging the cooling agent through the PWM valve 3 which is turned on. The compressor 2 has loading and unloading times varied in response to a duty control signal inputted from an outdoor control unit, as described later, according to an indoor required cooling capacity. Referring to FIG. 2, parts indicated by oblique lines represent the amount of discharged cooling agent.

Figure 3:
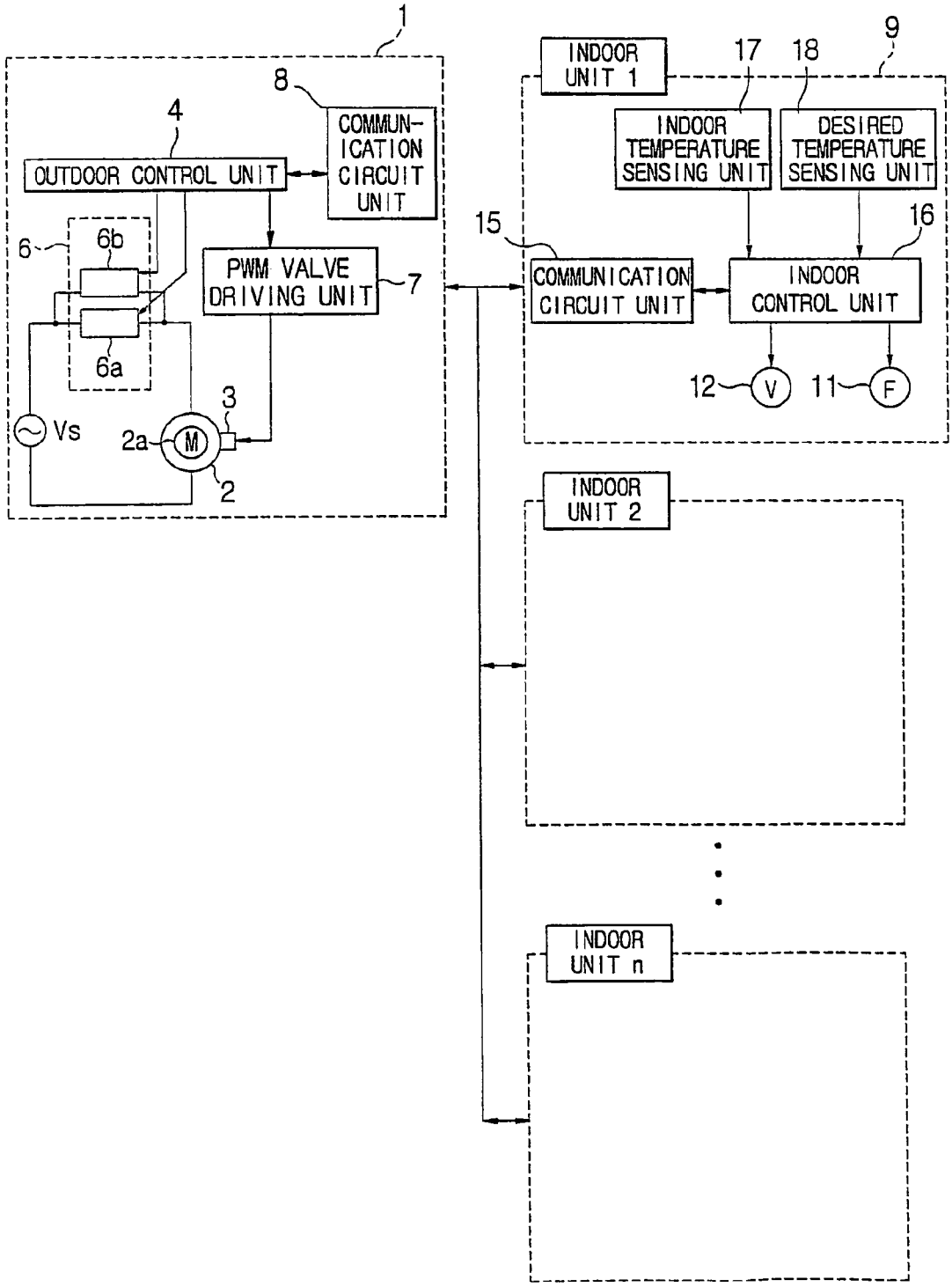
FIG. 3 is a block diagram of an air conditioning unit according to a preferred embodiment of the present invention.

FIG. 3 is a block diagram of an air conditioning unit according to a preferred embodiment of the present invention.

As shown in FIG. 3, the outdoor unit 1 comprises a communication circuit unit 8, an outdoor control unit 4, a power level control unit 6 and a PWM valve driving unit 7. The communication circuit unit 8 transmits/receives data to/from the indoor unit group 9. The outdoor control unit 4 is connected to the communication circuit unit 8 to enable transmission/reception of signals to/from the communication circuit unit 8. The power level control unit 6 controls the level of power supplied to a motor 2*a* of the compressor under the control of the outdoor control unit 4. The PWM valve driving unit 7 drives the PWM valve 3 under the control of the outdoor control unit 4.

The power level control unit 6 is comprised of a first supplying unit 6*a* to supply power of a first level (first level power) to the compressor motor 2*a*, and a second supplying unit 6*b* to supply power of a second level (second level power) to the compressor motor 2*a*. In this case, the second level power is less than the first level power.

The first and second supplying units 6*a* and 6*b* are connected in parallel with each other and electrically connected between alternating current (AC) power source Vs and the motor 2*a* to form a closed circuit. The first supplying unit 6*a* supplies the first level power during a loading operation of the compressor 2, while the second supplying unit 6*b* supplies the second level power during an unloading operation of the compressor 2. When the first supplying unit 6*a* supplies the first level power to the compressor motor 2*a*, the second supplying unit 6*b* is not operated, that is, not activated. On the contrary, when the second supplying unit 6*b* supplies the second level power to the compressor motor 2*a*, the first supplying unit 6*a* is not operated, that is, not activated.

Accordingly, the compressor motor 2*a* is supplied with the first level power during the loading operation of the compressor 2, and supplied with the second level power less than the first level power during the unloading operation of the compressor 2.

Each of the indoor units of the indoor unit group 9 comprises a communication circuit unit 15 to transmit/receive data to/from the outdoor unit 1, an indoor temperature sensing unit 17, a desired temperature setting unit 18, an indoor fan 11, the electric expansion valve 12, and an indoor control unit 16 connected to the above units to enable transmission/reception of signals.

The indoor control unit 16 receives indoor temperature data sensed by the indoor temperature sensing unit 17 and temperature data preset by the desired temperature setting unit 18. The indoor control unit 16 has information on a cooling capacity of the indoor control unit 16 itself. Further, the indoor control unit 16 may calculate a required cooling capacity on the basis of a difference between the indoor temperature and the preset temperature, and the cooling capacity of the indoor control unit 16. Alternatively, the indoor control unit 16 may calculate the required cooling capacity on the basis of only a cooling capacity of each indoor unit. The required cooling capacity calculated by each indoor unit of the indoor unit group 9 is transmitted to the outdoor control unit 4 through the communication circuit units 8 and 15.

The outdoor control unit 4 calculates a total required cooling capacity by summing up required cooling capacities of respective indoor units, and then varies the capacity of the compressor 2 on the basis of the calculated total required cooling capacity. That is, the outdoor control unit 4 calculates an operation rate of the compressor according to the total required cooling capacity, and determines a loading time and an unloading time on the basis of the operation rate of the compressor. In this case, the loading time corresponds to a turn off time of the PWM valve 3, and the unloading time corresponds to a turn on time of the PWM valve 3.

The outdoor control unit 4 determines the level of power to be supplied to the compressor motor 2*a* according to whether an operation cycle of the compressor 2 is the loading operation or the unloading operation. Then, the outdoor control unit 4 controls the power level control unit 6 according to the determined power level.

Figure 4:
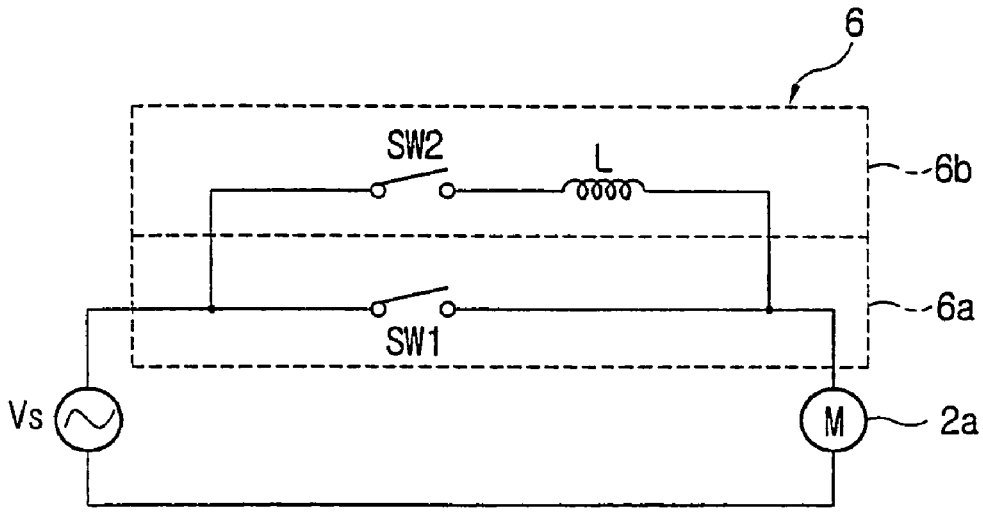
FIG. 4 is a detailed block diagram of a power level control unit of the air conditioning unit according to the present invention.

Referring to FIG. 4, the power level control unit 6 is comprised of the first supplying unit 6*a* to supply the first level power to the compressor motor 2*a* during the loading operation, and the second supplying unit 6*b* to supply the second level power to the compressor motor 2*a* during the unloading operation.

The first supplying unit 6*a* includes a first switch SW1 which is turned on or off according to an operation of the outdoor control unit 4. The first switch SW1 is connected in series between the AC power Vs and the compressor motor 2*a*. The second supplying unit 6*b* is comprised of a second switch SW2 which is turned on or off according to the operation of the outdoor control unit 4, and a coil L. The second switch SW2 and coil L are disposed in series between the AC voltage source Vs and the compressor motor 2*a* while being connected in series with each other, and are connected in parallel with the first switch SW1.

The coil L functions as a reactor to restrict (reduce) a voltage of the AC power Vs. Another electrical part having the same function as the coil L can be used in place of the coil L.

The coil L supplies voltage-restricted power, that is, the second level power, to the compressor motor 2*a*. In this case, the restricted voltage is determined by reactance of the coil L, and the second level power is less than the first level power.

Figure 5A:
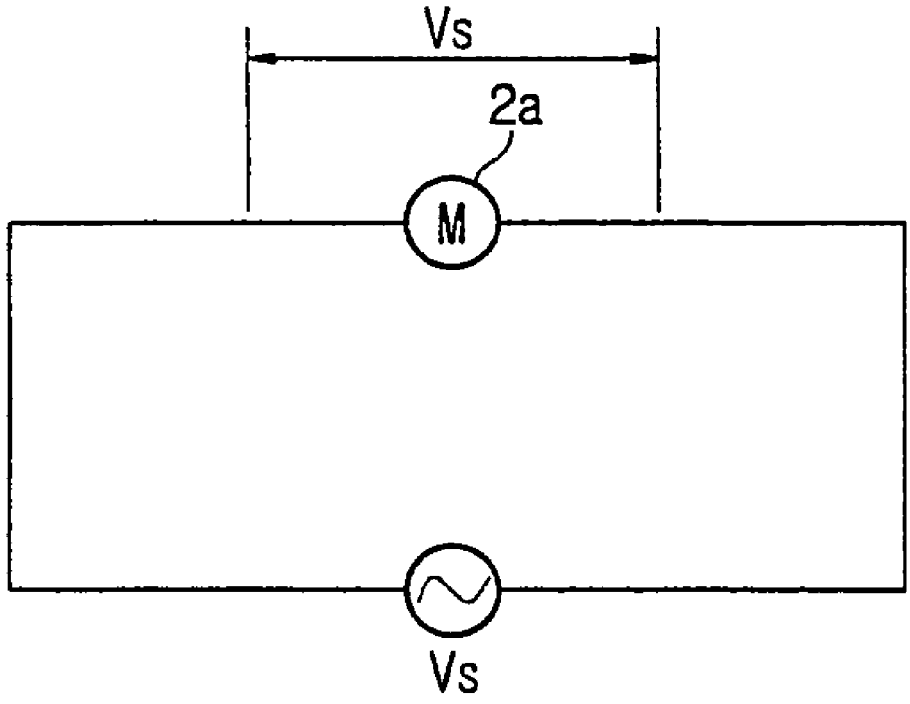
FIG. 5A is a modeled circuit diagram of a circuit in which first level power is supplied to a motor of the compressor during a loading operation according to the present invention.

If the operation cycle of the compressor is the loading operation, the outdoor control unit 4 turns on the first switch SW1 of the first supplying unit 6*a*, and turns off the second switch SW2 of the second supplying unit 6*b*. Accordingly, the first level power to which the AC power Vs is not restricted is supplied to the compressor motor 2*a*, which operation is modeled as a circuit shown in FIG. 5A.

Figure 5B:
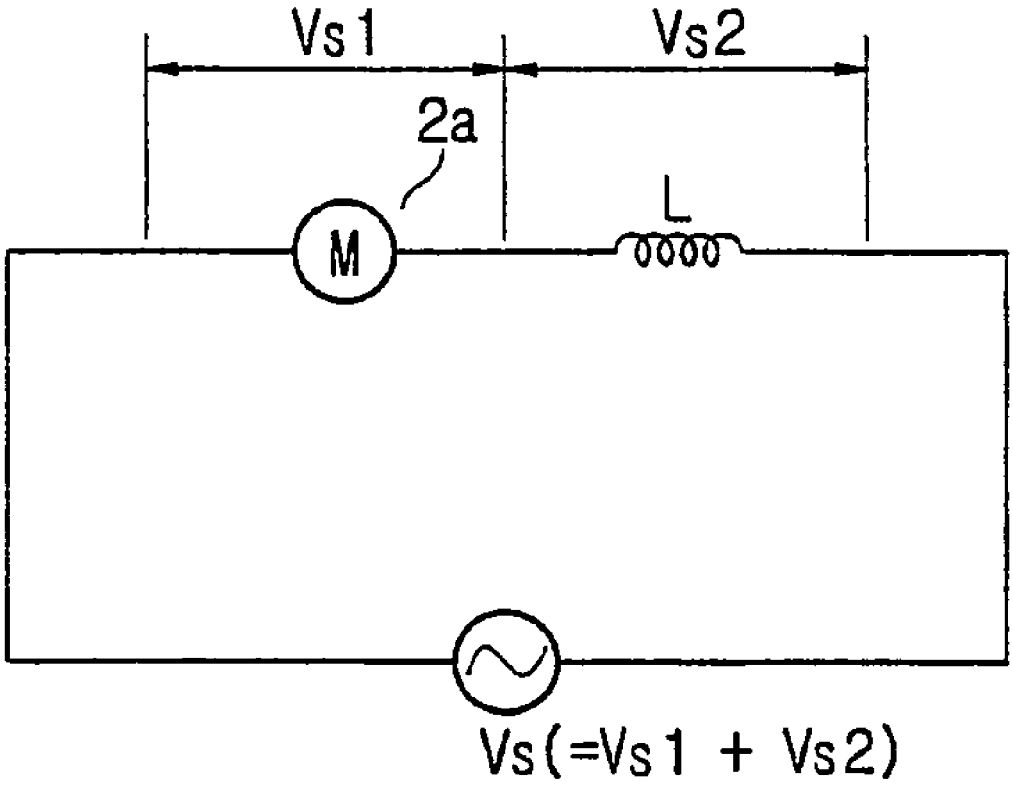
FIG. 5B is a modeled circuit diagram of a circuit in which second level power is supplied to the motor of the compressor during an unloading operation according to the present invention.

If the operation cycle of the compressor is the unloading operation, the outdoor control unit 4 turns on the second switch SW2 of the second supplying unit 6*b*, and turns off the first switch SW1 of the first supplying unit 6*a*. Accordingly, the second switch SW2 is turned on, so the AC power Vs is restricted by the coil L. That is, the voltage of the AC power Vs is reduced by a predetermined voltage to generate the second level power, which is supplied to the compressor motor 2*a*. This operation is modeled as a circuit shown in FIG. 5B. Referring to FIG. 5B, a voltage Vs1 present at both ends of the compressor motor 2*a* is less than the power voltage Vs by a voltage Vs2 equal to a voltage drop induced by the coil L.

Figure 6:
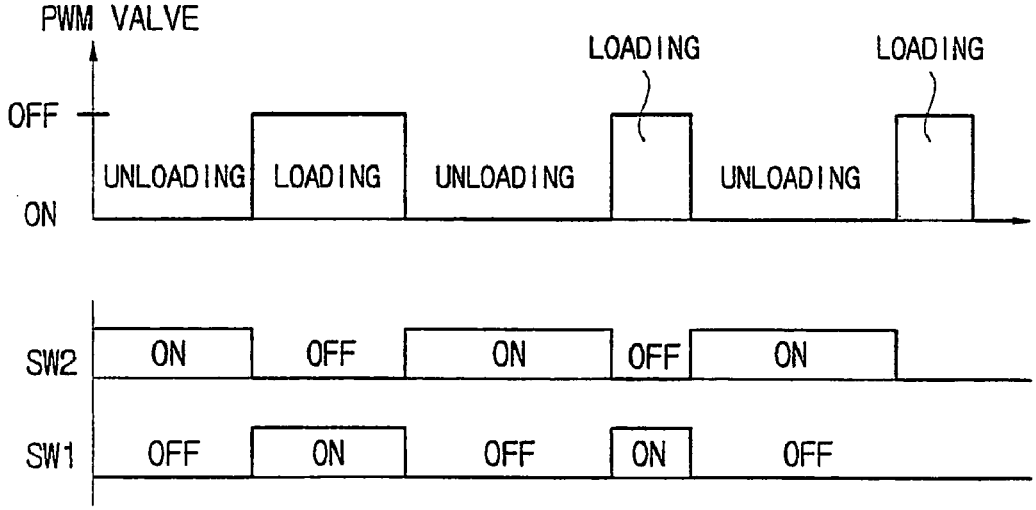
FIG. 6 is a view showing operations of controlling first and second switches and a PWM valve during loading and unloading operations according to the present invention.

Referring to FIG. 6, the outdoor control unit 4 controls the PWM valve driving unit 7 according to the total required cooling capacity obtained by summing up required cooling capacities of the indoor units to allow the compressor 2 to periodically perform the loading and unloading operations. In this case, the PWM valve 3 is turned off during the loading operation, and turned on during the unloading operation. The outdoor control unit 4 turns on the first switch SW1 and turns off the second switch SW2 so as to supply the first level power to the motor 2*a* during the loading operation. Further, the outdoor control unit 4 turns off the first switch SW1 and turns on the second switch SW2 so as to supply the second level power to the motor 2*a* during the unloading operation.

Figure 7:
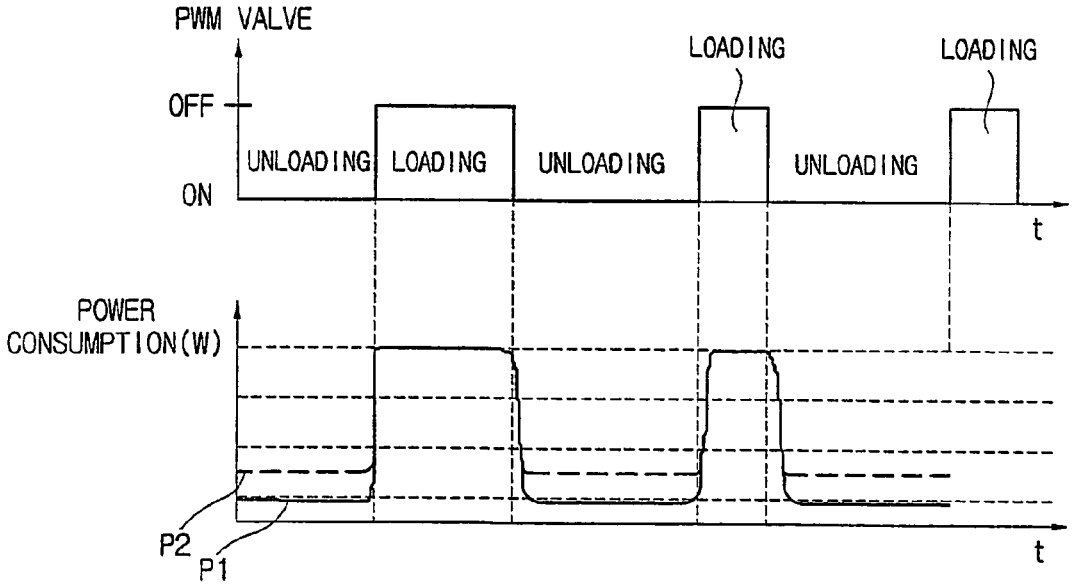
FIG. 7 is a view showing power consumption during loading and unloading operations according to the present invention.

As described above, the outdoor control unit 4 oppositely controls the first and second switches SW1 and SW2 according to the operation cycle of the compressor. As shown in FIG. 7, power consumption P1 during the unloading operation becomes less than the power consumption P2 during the loading operation. That is, only minimal power for no-load operation is supplied during the unloading operation.

Figure 8:
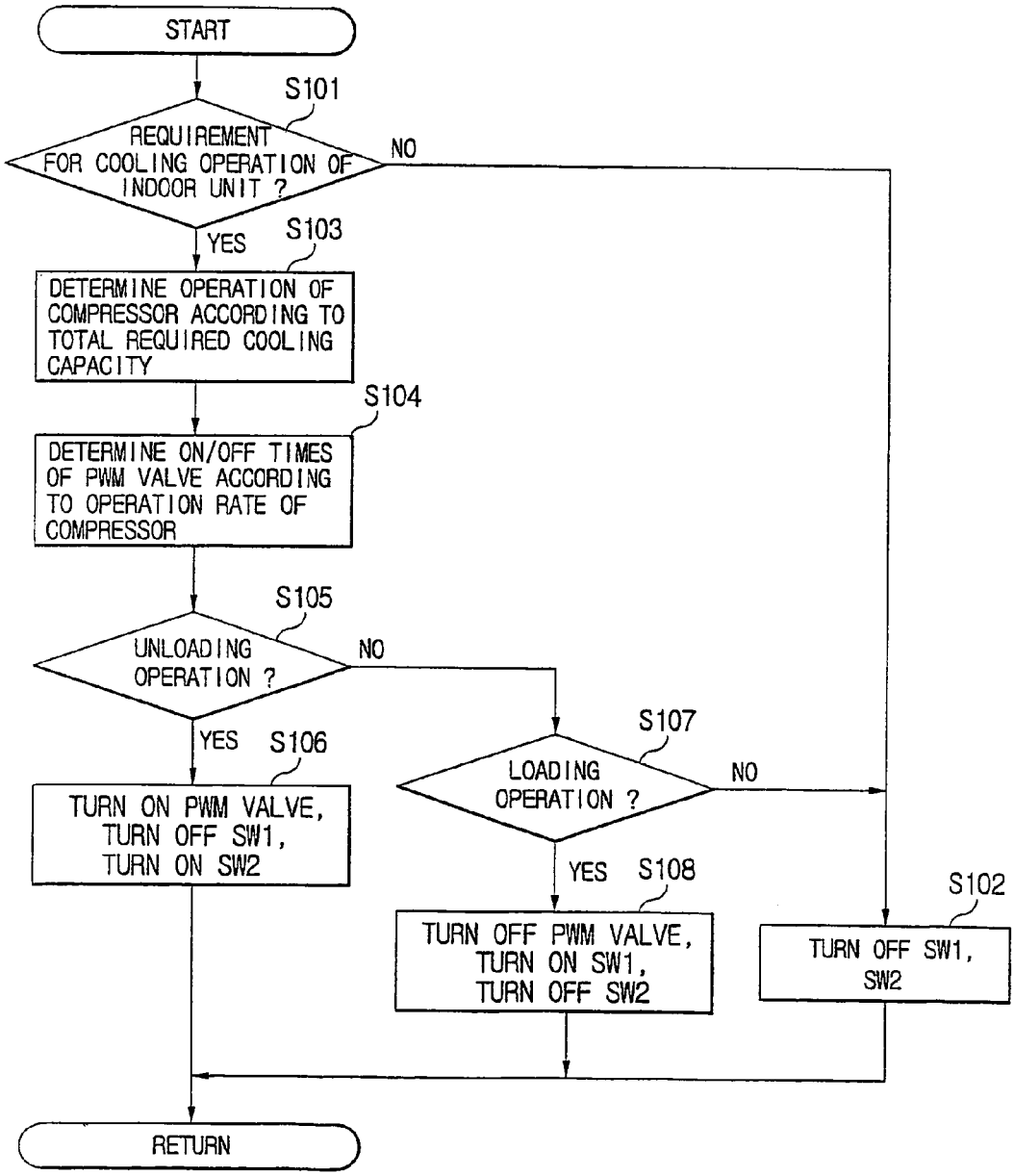
FIG. 8 is a flowchart of a method of operating the air conditioning unit according to the present invention.

Hereinafter, a method of operating the air conditioning unit having the above construction is described with reference to FIG. 8.

The outdoor control unit 4 calculates a total required cooling capacity by summing up required cooling capacities transmitted from respective indoor units of the indoor unit group 9, and determines whether there is any requirement for a cooling operation of an indoor unit at step S101. If there is no requirement for a cooling operation of an indoor unit, that is, if the total required cooling capacity is "0", the outdoor control unit 4 turns off the first and second switches SW1 and SW2 to stop the compressor 2 at step S102.

If there is any requirement for a cooling operation of an indoor unit at step S101, the outdoor control unit 4 determines an operation rate of the compressor according to the calculated total required cooling capacity at step S103. Then, the outdoor control unit 4 determines on and off times of the PWM valve 3 within a given cycle in correspondence with the operation rate of the compressor at step S104.

Then, the outdoor control unit 4 determines whether the operation cycle of the compressor is the unloading operation at step S105. If the operation cycle of the compressor is the unloading operation, the outdoor control unit 4 controls the PWM valve driving unit 7 to turn on the PWM valve 3, and simultaneously turns off the first switch SW1 and turns on the second switch SW2 so as to supply the second level power to the compressor motor 2*a* at step S106.

If the operation cycle of the compressor is not the unloading operation at step S105, the outdoor control unit 4 determines whether the operation cycle of the compressor is the loading operation at step S107. If the operation cycle is the loading operation, the outdoor control unit 4 controls the PWM valve driving unit 7 to turn off the PWM valve 3, and simultaneously turns on the first switch SW1 and turns off the second switch SW2 so as to supply the first level power to the compressor motor 2*a* at step S108.

If the operation cycle of the compressor is not the loading operation at step S107, a next processing step returns to step S102 to stop the compressor 2 by turning off the first and second switches SW1 and SW2.

In the above embodiment of the present invention, an apparatus and method of controlling the level of power supplied to the compressor motor by using a coil as a reactor is used. Contrary to this embodiment, there will be described another embodiment for controlling the level of power supplied to the compressor motor by adjusting a voltage and a frequency of the AC power.

Figure 9:
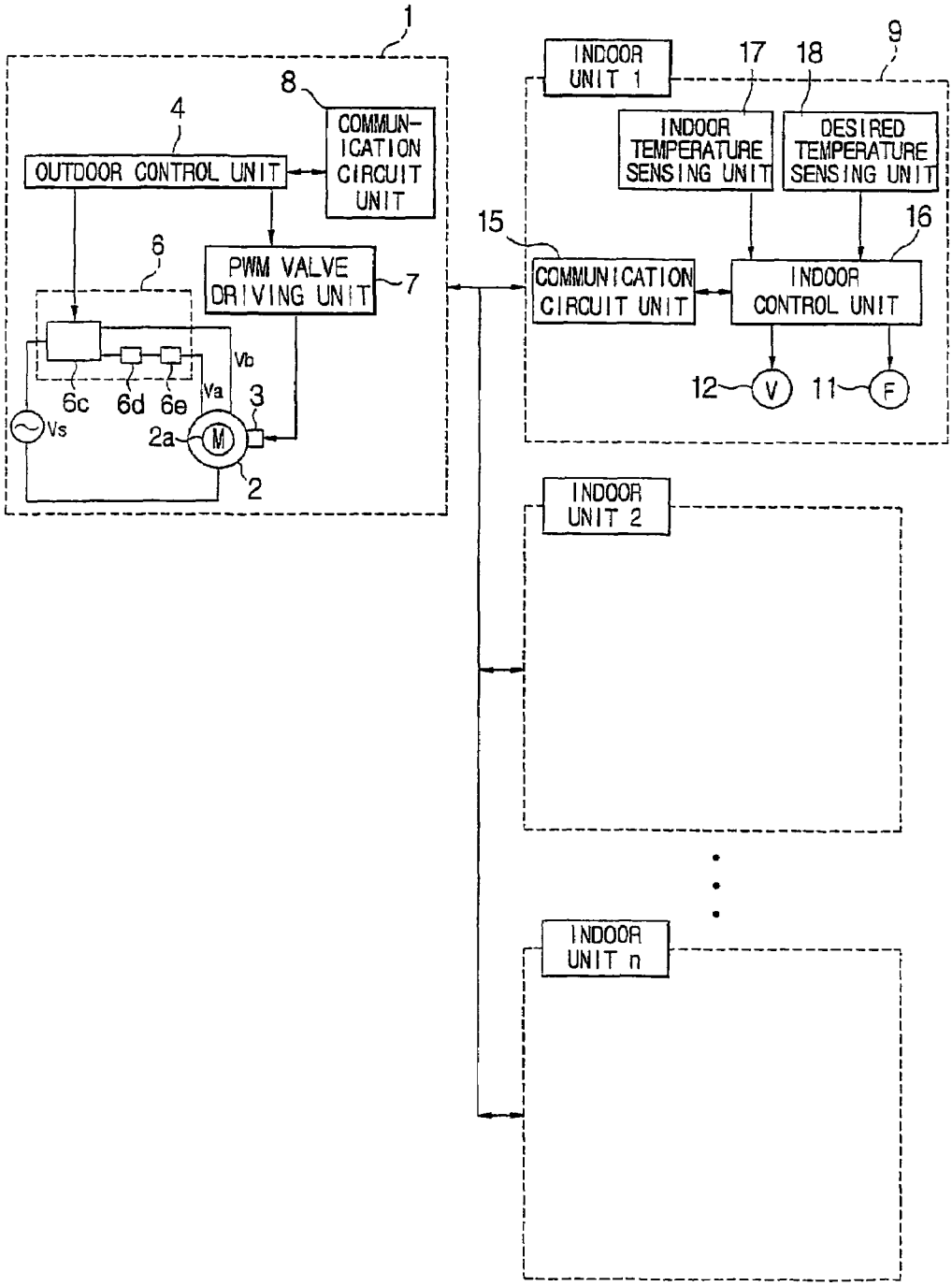
FIG. 9 is a block diagram of another air conditioning unit according to another preferred embodiment of the present invention.

FIG. 9 is a block diagram of another air conditioning unit according to another preferred embodiment of the present invention.

As shown in FIG. 9, the power level control unit 6 controls the level of power supplied to the compressor motor 2*a* under the control of the outdoor control unit 4, and is electrically connected between the AC power and the compressor motor 2*a* to form a closed circuit. The power level control unit 6 is comprised of a switching unit 6*c*, a converting unit 6*d* and an inverting unit 6*e*.

The outdoor control unit 4 controls the switching unit 6*c* according to the operation cycle of the compressor. During the loading operation of the compressor, the switching unit 6*c* directly supplies the AC power to the compressor motor 2*a*, and the compressor motor 2*a* is supplied with first level power.

During the unloading operation of the compressor, the switching unit 6*c* outputs the AC power to the converting unit 6*d*. The converting unit 6*d* converts the AC power into direct current (DC) power, and outputs the DC power to the inverting unit 6*e*. The inverting unit 6*e* inverts the DC power into AC power, and simultaneously supplies second level power obtained by reducing the voltage and frequency of the AC power Vs by a predetermined amount to the compressor motor 2*a*.

Figure 10:
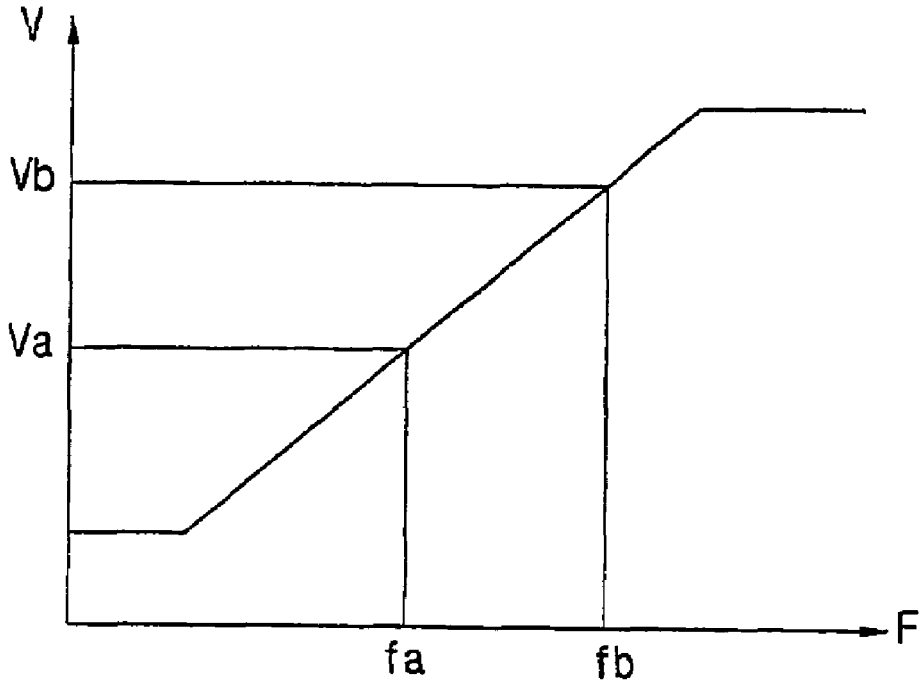
FIG. 10 is a graph showing a relationship between a voltage and a frequency to describe characteristics of the motor of the compressor.

Referring to FIG. 10, a voltage Va and a frequency fa of the second level power supplied to the compressor motor 2*a* during the unloading operation respectively decrease compared with a voltage Vb and a frequency fb of the first level power supplied to the compressor motor 2*a* during the loading operation, thus preventing generation of undesirable power consumption.

As described above, the present invention provides an air conditioning unit and method of controlling the same, which supplies first level power for compressing a cooling agent if an operation cycle of a compressor is a loading operation, and supplies second level power less than the first level power as minimal power for no-load operation if the operation cycle of the compressor is an unloading operation, thus decreasing undesirable power consumption caused by a compressor motor during the unloading operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A pulse width modulation (PWM) compressor, comprising:

a motor;

a first motor controller for supplying first level power to said motor during a loading operation of said compressor; and a second motor controller for supplying second level power less than said first level power to said motor during an unloading operation of said compressor.

2. The PWM compressor according to claim 1, wherein said second motor controller comprises restricting means for restricting alternating current (AC) power.

3. The PWM compressor according to claim 2, wherein said restricting means restricts said AC power by reducing a voltage of said AC power.

4. The PWM compressor according to claim 3, wherein said restricting means is comprised of a switch and a reactor which are disposed between said AC power and said motor while being connected in series with each other.

5. The PWM compressor according to claim 4, wherein said reactor is a coil.

6. A compressor having operation cycles including a loading operation and an unloading operation, comprising:

a motor for receiving first level power during said loading operation of said compressor and receiving second level power less than said first level power during said unloading operation of said compressor.

7. An air conditioning unit, comprising:

a compressor for performing a loading operation and an unloading operation and compressing a cooling agent during said loading operation, said compressor including a motor for receiving first level power during said loading operation of said compressor and receiving second level power less than said first level power during said unloading operation.

8. The air conditioning unit according to claim 7, wherein said second level power is minimal power required to operate said compressor.

9. A method of operating a compressor in an air conditioning unit, said compressor having a loading operation for compressing a cooling agent and an unloading operation, comprising the steps of:

supplying first level power to a motor of said compressor during said loading operation; and supplying second level power less than said first level power to said motor during said unloading operation.

10. An air conditioning unit comprising:

a compressor having a loading operation for compressing a cooling agent and an unloading operation; and a controller for controlling said compressor, said controller comprising, a power level control circuit for controlling power level supplied to a motor of said compressor, said power level control circuit allowing first level power to be supplied to said motor during said loading operation and allowing second level power less than said first level power to be supplied to said motor during said unloading operation.

11. The air conditioning unit according to claim 10, wherein said power level control circuit comprises restricting means for restricting alternating current (AC) power.

12. The air conditioning unit according to claim 11, wherein said restricting means restricts said AC power by reducing a voltage and a frequency of said AC power.

13. The air conditioning unit according to claim 12, wherein said restricting means is comprised of a converting unit for converting said AC power into direct current (DC) power, and an inverting unit for inverting the DC power into AC power and reducing the voltage and frequency of said AC power to be supplied to said motor of said compressor.

* * * * *